US009664384B2

(12) United States Patent
Biegner et al.

(10) Patent No.: US 9,664,384 B2
(45) Date of Patent: May 30, 2017

(54) VALVE ARRANGEMENT

(71) Applicants: André Biegner, München (DE); Anton Wellenhofer, Hohenschäftlarn (DE)

(72) Inventors: André Biegner, München (DE); Anton Wellenhofer, Hohenschäftlarn (DE)

(73) Assignee: Linde Aktiengesellschaft, Munich (DE)

( * ) Notice: Subject to any disclaimer, the term of this patent is extended or adjusted under 35 U.S.C. 154(b) by 101 days.

(21) Appl. No.: 14/681,231

(22) Filed: Apr. 8, 2015

(65) Prior Publication Data

US 2015/0292643 A1 Oct. 15, 2015

(30) Foreign Application Priority Data

Apr. 10, 2014 (EP) ..... 14001394

(51) Int. Cl.
*F23K 5/14* (2006.01)

(52) U.S. Cl.
CPC ..... *F23K 5/147* (2013.01); *F23K 2301/206* (2013.01); *F23K 2900/05002* (2013.01); *F23N 2035/18* (2013.01); *Y10T 137/2605* (2015.04); *Y10T 137/2615* (2015.04)

(58) Field of Classification Search
CPC ..... Y10T 137/2605; Y10T 137/2607; Y10T 137/2612; Y10T 137/2615; Y10T 137/2663; Y10T 137/2668; Y10T 137/2693; Y10T 137/2695
See application file for complete search history.

(56) References Cited

U.S. PATENT DOCUMENTS

| | | | | |
|---|---|---|---|---|
| 2,412,428 | A * | 12/1946 | Rockwell | G05D 16/10 137/115.15 |
| 4,554,942 | A | 11/1985 | Williams et al. | |
| 5,135,161 | A * | 8/1992 | Goodman | B64D 13/08 137/118.06 |
| 5,727,589 | A | 3/1998 | Yokogi | |
| 5,944,043 | A | 8/1999 | Glick et al. | |
| 6,260,568 | B1 | 7/2001 | Hsu et al. | |
| 6,435,860 | B1 | 8/2002 | Brookshire et al. | |
| 2004/0040600 | A1 * | 3/2004 | Cavagna | F16K 17/30 137/505.11 |
| 2006/0151027 | A1 | 7/2006 | Pearson | |
| 2006/0216663 | A1 | 9/2006 | Morrissey | |
| 2008/0190488 | A1 * | 8/2008 | Hurst | F16K 11/22 137/119.03 |
| 2011/0070063 | A1 | 3/2011 | Snuttjer | |
| 2013/0019979 | A1 | 1/2013 | Helmschrott et al. | |

FOREIGN PATENT DOCUMENTS

DE 44 00908 A1 7/1994

* cited by examiner

*Primary Examiner* — R. K. Arundale
(74) *Attorney, Agent, or Firm* — David A. Hey

(57) ABSTRACT

Valve arrangement for a system which is loaded with fluid, for connecting a first pressure region to a second pressure region by means of a first valve and a second valve connected in series. A third valve connects a region between the first valve and the second valves to a third pressure region. The first valve closes when a pressure which prevails on the side of the second pressure region is at least as high as a pressure which prevails on the side of the first pressure region. The first valve is coupled to the second valve so that the second valve closes when the first valve closes. The second valve is coupled to the third valve so that the third valve opens when the second valve closes.

12 Claims, 2 Drawing Sheets

VALVE ARRANGEMENT

The invention relates to a valve arrangement for a system in which is loaded with ha fluid, for connecting a first pressure region to a second pressure region, in particular a low-pressure region to a high-pressure region.

PRIOR ART

In plants or systems which conduct a fluid, that is to say gas and/or liquid, supply with the fluid often takes place via a low-pressure region, that is to say part of the plant which is designed for low-pressure which is sufficient for the supply and a storage vessel and/or tank.

In contrast, a high-pressure region, that is to say part of the plant which is designed for loading with the fluid under a high-pressure, is utilized as the process side. When plant parts for low-pressure are incorporated into systems or parts thereof for high-pressure, it has to then be ensured that, in the case of possible operational disruptions, no back-flow of the fluid from the high-pressure region into the low-pressure region occurs.

Here, the low-pressure and high-pressure regions are often also called the low-pressure and high-pressure sides, since they represent two sides of a plant which are designed for different pressures, that is to say pipelines, apparatuses and other equipment parts.

A back-flow of this type would have various consequences, such as a permissible pressure (a design pressure) being exceeded in the low-pressure region, the contamination of the low-pressure region with substances from the high-pressure region or, in the case of liquid metering in gas systems, the back-flow of gas into the liquid-filled system.

Consequences of this type, in particular the two mentioned first, represent a safety risk, and the consequence mentioned last can lead at least to operational disruptions, such as failure of a pump.

Depending on the type of or severity of the consequences, different safeguard concepts are followed in the prior art. A common feature of them is that an automatic non-return valve is used. However, non-return valves of this type usually have the disadvantage that they are not completely sealed, as a result of which they continue to be permeable for the fluid. In particular at high-pressure, this leads to what are known as creeping flows from the high-pressure region into the low-pressure region.

Further measures are therefore also required, in order to prevent or at least to reduce said consequences. In the case of liquid metering, for example, a safety valve is used for preventing impermissible pressure exceeding, as also described further below with reference to FIG. 1. However, the contamination of the low-pressure region with undesired substances cannot be prevented here either.

The present invention therefore has the object of providing an effective shut-off apparatus for connecting a low-pressure region to a high-pressure region in a system which is loaded with fluid.

DISCLOSURE OF THE INVENTION

This object is achieved by way of a valve arrangement for a system which is loaded with a fluid, for connecting a first pressure region to a second pressure region.

A valve arrangement according to the invention is used for a system which is loaded with a fluid, for connecting a first pressure region to a second pressure region. Here, the connection takes place by means of a first valve and a second valve which is connected in series thereto. Here, the first pressure region comprises, in particular, a low-pressure region, that is to say a plant part which is designed for low-pressure and/or is operated at low-pressure, and the second pressure region comprises a high-pressure region, that is to say a plant part which is designed for high-pressure and/or can be operated at high-pressure. A third valve connects a region between the first and the second valves to a third pressure region, in which the pressure, in particular the operating pressure, is lower, in particular, than in the first pressure region; for example, this is an open outlet to a flare, that is to say atmospheric pressure prevails as a rule. The first valve is set up such that it closes when a pressure which prevails on the side of the second pressure region is at least as high as a pressure which prevails on the side of the first pressure region. In particular, the first valve is process medium-controlled for this purpose. In addition, the first valve is coupled to the second valve in such a way that the second valve closes when the first valve closes, and the second valve is coupled to the third valve in such a way that the third valve opens when the second valve closes.

Advantages of the Invention

According to the invention, the connection between the first and the second pressure regions is closed or shut off by the first and the second valves. Fluid which remains here in the region between the first and second valves can flow away via the third valve; ventilation therefore takes place. Since a lower pressure prevails in the region between the first and second valves than in the first pressure region, no back-flow of fluid into the first pressure region can occur. The operation of shutting off and ventilating takes place completely automatically by way of the valve arrangement. Even if the first and second valves are not then completely sealed, no fluid flows from the second pressure region into the first pressure region, since the fluid instead flows away via the third valve into the third pressure region. Exceeding of the pressure in the first pressure region, that is to say, in particular, the low-pressure region, is therefore prevented effectively. No contamination with undesired substances can likewise take place there. In the case of liquid metering, no back-flow of gas takes place into the liquid-filled system in the low-pressure region either.

The first valve is preferably coupled to the second valve via a switching apparatus, in particular a valve or solenoid valve. This makes particularly effective shutting off possible, since the closure of the second valve can take place particularly rapidly by way of a correspondingly designed switching apparatus.

The first valve is advantageously coupled to the switching apparatus mechanically, pneumatically or hydraulically. Depending on the configuration of the valve arrangement, in particular the spatial configuration, and/or the available components of valve connectors, optimum coupling can therefore be selected which ensures a rapid operative connection.

It is advantageous if the second valve is coupled to the switching apparatus electrically, hydraulically or pneumatically. Here too, depending on the configuration of the valve arrangement, in particular the spatial configuration, and/or the available components of valve connectors, optimum coupling can be selected which ensures a rapid operative connection. In particular, the coupling between the first valve and the switching apparatus and the second valve and the switching apparatus can be identical. However, different coupling types are certainly also conceivable if, as a result, cost or efficiency advantages can be achieved, for example. If an instrument/air connector is available, for example, on a compressed air store, pneumatic coupling of the switching apparatus and the second valve can be selected, for example.

Furthermore, it is advantageous if the second valve is coupled to the third valve mechanically, electrically, hydraulically or pneumatically. Depending on the configuration, coupling which is optimum and as efficient as possible can thus be selected, in particular also depending on the coupling of the second valve to the switching apparatus. In the case of mechanical coupling of the second valve to the third valve, the third valve requires no dedicated valve drive, for example, but rather can be driven via the valve drive of the second valve. It is also conceivable that the third valve is coupled indirectly to the second valve via the switching apparatus. This is certainly effective, for example, in the case of electrical coupling and an electric switching apparatus.

The first valve is preferable closer to the first pressure region than the second valve. In particular, the low-pressure region is secured in this way be way of a process medium-controlled valve. Since, in the case of an excessively high-pressure on the side of the second pressure region, that is to say, in particular, the high-pressure region, the first valve closes or shuts off first, the contamination with undesired substances from the high-pressure region is prevented most effectively in this way.

A pressure in the third pressure region is advantageously lower than the second pressure region, the third pressure region having, in particular, a connection to a disposal system, a flare and/or atmosphere. This ensures that fluid which, in the case of a leaky second valve, flows out of the second pressure region into the region between the first and second valves is discharged immediately via the third valve, in particular, to the atmosphere and/or to the flare or disposal means. The fluid therefore also cannot flow via a possibly leaky first valve into the first pressure region. The third valve therefore also acts like a ventilating valve.

Moreover, the invention relates to use of the explained valve arrangement according to the invention for preventing an undesired back-flow from a high-pressure region into a low-pressure region, in particular in the case of an operational disruption. In this regard, reference is made to the above and the following explanation.

Further advantages and refinements of the invention result from the description and the appended drawing.

It goes without saying that the features which are mentioned above and are still to be explained in the flowing text can be used not only in the respectively specified combination, but rather also in other combinations or on their own, without departing from the scope of the present invention.

The invention is shown diagrammatically using one exemplary embodiment in the drawing and will be described in detail in the following text with reference to the drawing.

EMBODIMENTS OF THE INVENTION

Figure 1:
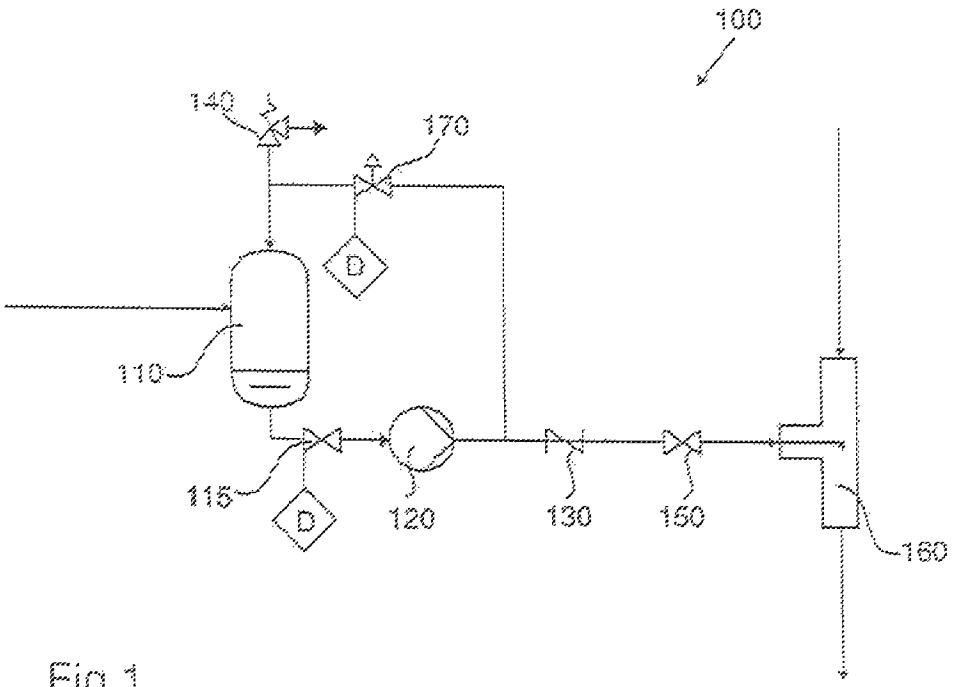
FIG. 1 shows a shut-off valve arrangement with a non-return valve and safety valve in the case of liquid metering according to the prior art.

FIG. 1 diagrammatically shows a system 100 for liquid metering. A refillable tank 110 serves as supply for a fluid which is present as a liquid. The liquid is guided via a valve 115 to a pump 120, by means of which a corresponding pressure can be built up, in order to forward the liquid to a distributor 160.

A non-return valve 130 and a further metering and/or shut-off valve 150 are arranged between the pump 120 and the distributor 160. The non-return valve divides the system 100 into a low-pressure region with the tank 110 and a high-pressure region with the distributor 160, via which the fluid is introduced gaseously into a process circuit. It is to be noted here that a part of the system 100 which is designed for high pressures is usually called the high-pressure side or high-pressure region. However, during regular operation, a somewhat higher pressure prevails on the low-pressure side or in the low-pressure region than on the high-pressure side, or at least part of the high-pressure side, since otherwise no transport of the fluid in the direction of the high-pressure side would be possible.

In addition, a branch is provided between the pump 120 and the non-return valve 130 in the low-pressure region, which branch leads via a shut-off valve 170 to a safety valve 140.

In the case of an excess pressure in the high-pressure region, for example on account of an operational disruption, the non-return valve 130 then closes automatically. This is intended to prevent a permissible pressure in the low-pressure region being exceeded.

In reality, however, a non-return valve is not completely sealed, that is to say 100%. This therefore nevertheless leads as a rule to excess pressure on the low-pressure side as a result of back-flowing gas. Said excess pressure can be dissipated by way of the safety valve 140, in the case of an open shut-off valve 170. A safety valve 140 opens automatically at a corresponding excess pressure, it being possible as a rule for the magnitude of the excess pressure, at which the safety valve 140 opens, to be set and/or adjusted.

However, the valve arrangement in the system 100 cannot prevent undesired substances which are situated in the fluid in the high-pressure region passing into the low-pressure region through the leaky non-return valve 130 in the case of an excess pressure.

Figure 2:
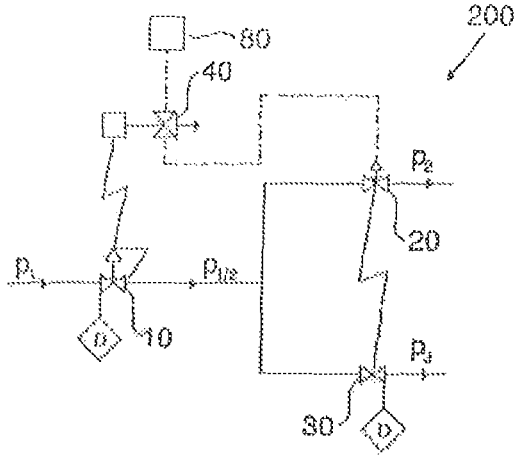
FIG. 2 shows one preferred refinement of a valve arrangement according to the invention.

FIG. 2 diagrammatically shows a valve arrangement 200 according to the invention in one preferred refinement. The valve arrangement 200 serves to connect a first pressure region p1 which is configured as a low-pressure region to a second pressure region p2 which is configured as a high-pressure region in a system which is loaded with fluid. Since the valve arrangement 200 connects two sides with different pressure regions, the low-pressure region p1 is also called the low-pressure side and the high-pressure region p2 is also called the high-pressure side. It is to be noted here that a part of the system which is designed for high pressures is usually called the high-pressure side. However, during regular operation, a somewhat higher pressure prevails on the low-pressure side than on the high-pressure side, or at least part of the high-pressure side, since otherwise no transport of the fluid in the direction of the high-pressure side would be possible.

The connection takes place via a first valve 10 and a second valve 20 which is connected in series thereto. Here, a region p1/2 is formed between the first valve 10 and the second valve 20. The first valve 10 is configured as a process medium-controlled valve. It closes automatically as soon as the pressure which prevails in the high-pressure region p2, in this case also and in particular in the region p1/2, is at least precisely as high as the pressure which prevails in the low-pressure region p1.

The first valve 10 is coupled to a switching apparatus 40 which is configured as a solenoid valve. This coupling can be, for example, electric. In the case of a differently configured switching apparatus 40, a different type of coupling can be more suitable, however. The solenoid valve 40 in turn is coupled to the second valve 20. Here, this coupling is configured in such a sway that the solenoid valve 40 can open and close a connection of the second valve 20 to a compressed air store 80. A valve drive of the second valve 20 is therefore driven here by means of compressed air, that is to say pneumatically.

Depending on the configuration, the second valve 20 can be closed by the solenoid valve 40 opening and closing the connection to the compressed air store.

The region p1/2 has a branch to a third valve 30 which connects the region p1/2 to a third pressure region p3. The third pressure region p3 has, for example, a connection to a flare system and therefore approximately atmospheric pressure.

The third valve 30 is then coupled to the second valve 20 in such a way that it is opened automatically as soon as the second valve 20 is closed. This coupling can take place, for example, mechanically. In this way, the third valve 30 does not require a dedicated valve drive, but rather is controlled by the valve drive of the second valve 20, which valve drive is in turn operated by means of compressed air.

Figure 3:
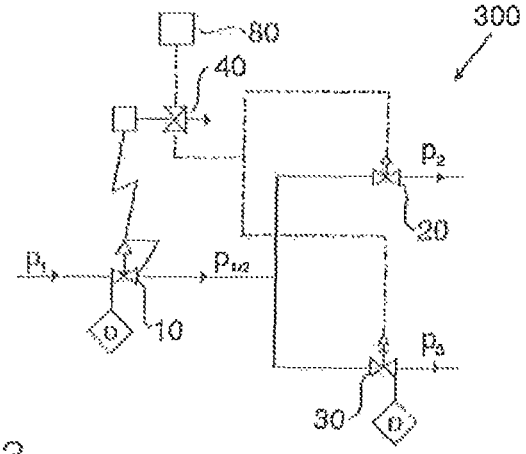
FIG. 3 shows a further preferred refinement of a valve arrangement according to the invention.

FIG. 3 diagrammatically shows a valve arrangement 300 according to the invention in a further preferred refinement. The valve arrangement 300 differs from the valve arrangement 200 which is shown in FIG. 2 merely in that the second valve 20 is not coupled directly to the third valve 30, but rather indirectly via a switching apparatus 40. The third valve 30 is coupled to the switching apparatus 40, for example by means of a compressed air connection just like the second valve 20. In this way, the second valve 20 and the third valve 30 are controlled in each case, in particular at the same time, by the switching apparatus 40, that is to say the second valve 20 is closed and the third valve 30 is opened.

The effects which are achieved by way of the valve arrangements 200 and 300 are identical, however, independently of the precise actuation of the second valve 20 and of the third valve 30. A distinction will therefore not be made between the two valve arrangements in the following text during the description of the method of operation.

A has already been mentioned, during normal operation of the system, the fluid flows from the low-pressure region p1 to the high-pressure region p2, where it is fed, for example, to a process. Here, the first valve 10 and the second valve 20 are open, and the third valve 30 is closed.

If, for example, an operational disruption then occurs in the high-pressure region p2, as a result of which the pressure rises, the pressure also rises in the region p1/2. A soon as the pressure in the region p1/2 is then at least as high as that in the low-pressure region p1, the first valve 10 closes automatically. Depending on how rapidly a pressure rise of this type takes place and how rapidly the first valve 10 can react and to which precise pressure conditions it is set, the first valve 10 already closes in the case of equal pressure between the region p1/2 and the low-pressure region p1 or else not until a certain excess pressure in the region p1/2; equal pressure is to be preferred, in particular, with regard to possible contamination of the tow-pressure region p1.

The closure of the first valve 10 is also accompanied by the closure of the second valve 20, as described above. This is therefore a double shut-off between the low-pressure region p1 and the high-pressure region p2.

Since opening of the third valve 30 takes place at the same time as the closure of the second valve 20, it is ensured that this pressure in the low-pressure region p1 is always greater than the pressure in the region p1/2. Pressure which would build up as a result of a possible leaky second valve 20 in the region p1/2 as a result of fluid which flows over fro the high-pressure region p2 is dissipated immediately via the third valve 30, since the fluid is discharged, for example, to the flare means and/or the atmosphere. The third valve 30 therefore has the action of a ventilating valve.

Since fluid which flows from the high-pressure region p2 in the direction of the low-pressure region p1 without exception flows out via the third valve 30, no fluid passes from the high-pressure region p2 into the low-pressure region p1. No undesired substance or contamination can therefore pass from the high-pressure region p2 into the low-pressure region p1 either.

Even in the case of liquid metering, no gas can therefore pass from the high-pressure region p2 into the low-pressure region p1, as a result of which disruptions might occur, for example, by way of pump failure.

The invention claimed is:

1. Valve arrangement for a system which is loaded with fluid, for connecting a first pressure region to a second pressure region by means of a first valve and a second valve which is connected in series thereto, a third valve connecting a region between the first valve and the second valve to a third pressure region; the first valve being set up such that the first valve closes when a pressure which prevails on a side of the second pressure region is at least as high as a pressure which prevails on a side of the first pressure region; the first valve being coupled to the second valve in such a way that the second valve closes when the first valve closes; the second valve being coupled to the third valve in such a way that the third valve opens when the second valve closes wherein the first valve is coupled via a switching apparatus to the second valve.

2. Valve arrangement according to claim 1, the switching apparatus having a valve.

3. Valve arrangement according to claim 2, wherein the valve of the switching apparatus is a solenoid valve.

4. Valve arrangement according to claim 1, the first valve being coupled to the switching apparatus mechanically, pneumatically or hydraulically.

5. Valve arrangement according to claim 1, the second valve being coupled to the switching apparatus electrically, hydraulically or pneumatically.

6. Valve arrangement according to claim 1, the second valve being coupled to the third valve mechanically, electrically, hydraulically or pneumatically.

7. Valve arrangement according to claim 1, the third valve being coupled to the switching apparatus electrically, hydraulically or pneumatically.

8. Valve arrangement according to claim 1, the first valve being arranged closer to the first pressure region than the second valve.

9. Valve arrangement according to claim 1, the first pressure region is at a lower pressure than the second pressure region.

10. Valve arrangement according to claim 1, a pressure in the third pressure region being lower than in the first pressure region.

11. Valve arrangement according to claim 1, the third pressure region having a connection to a disposal system, a flare system or atmosphere.

12. Method of preventing back-flow from a high-pressure region to a low-pressure region comprising:

providing a valve arrangement that connects the low-pressure region to the high-pressure region by means of a first valve and a second valve connected in series, and having a third valve connecting a region between the first valve and the second valve to a third pressure region;

closing the first valve when a pressure prevails on a side of the second pressure region that is at least as high as a pressure which prevails on a side of the first pressure region;

coupling the first valve to the second valve so that the second valve closes when the first valve closes; and coupling the second valve to the third valve so that the third valve opens when the second valve closes wherein the first valve is coupled via a switching apparatus to the second valve.

* * * * *